US006868769B1

(12) United States Patent
Wright

(10) Patent No.: US 6,868,769 B1
(45) Date of Patent: Mar. 22, 2005

(54) CONTAINERIZED ROCKET ASSISTED PAYLOAD (RAP) LAUNCH SYSTEM

(76) Inventor: James E. Wright, The Riverside, 1425 4th St., SW. #205, Washington, DC (US) 20024

( * ) Notice: Subject to any disclaimer, the term of this patent is extended or adjusted under 35 U.S.C. 154(b) by 0 days.

(21) Appl. No.: 10/749,553

(22) Filed: Jan. 2, 2004

(51) Int. Cl.[7] ..... F41F 3/042; F41F 3/055

(52) U.S. Cl. ..... 89/1.811; 89/1.804; 89/1.807; 89/1.814; 89/1.815; 89/1.816

(58) Field of Search ..... 89/1.804, 1.807, 89/1.811, 1.813, 1.814, 1.815, 1.816, 1.817, 1.818

(56) References Cited

U.S. PATENT DOCUMENTS

| | | | | | |
|---|---|---|---|---|---|
| 2,807,194 | A | * | 9/1957 | Cammin-Christy | 89/1.815 |
| 2,844,073 | A | * | 7/1958 | Re et al. | 89/1.807 |
| 3,680,749 | A | | 8/1972 | Davis | 244/3.14 |
| 4,063,485 | A | * | 12/1977 | Carter et al. | 89/1.816 |
| 4,267,562 | A | | 5/1981 | Raimondi | 358/109 |
| 4,681,017 | A | * | 7/1987 | Fischer et al. | 89/29 |
| 5,452,640 | A | | 9/1995 | Bovee et al. | 89/1.815 |
| 5,554,815 | A | | 9/1996 | Authie et al. | 89/1.59 |
| 5,564,649 | A | | 10/1996 | von Hoessle et al. | 244/3.12 |
| 5,855,339 | A | | 1/1999 | Mead et al. | 244/3.11 |
| 5,942,713 | A | | 8/1999 | Basak | 89/1.816 |
| 6,069,692 | A | | 5/2000 | Stoffberg | 244/3.11 |
| 6,125,734 | A | | 10/2000 | Yagla | 89/1.816 |
| 6,142,055 | A | * | 11/2000 | Borgwarth et al. | 89/1.817 |
| 6,152,011 | A | | 11/2000 | Ivy et al. | 89/1.814 |
| 6,487,952 | B1 | | 12/2002 | Borgwarth et al. | 89/1.81 |
| 6,491,253 | B1 | | 12/2002 | McIngvale | 244/3.11 |
| 2002/0170419 | A1 | | 11/2002 | Borgwarth et al. | |
| 2003/0089220 | A1 | | 5/2003 | Boudreau et al. | |

FOREIGN PATENT DOCUMENTS

| | | | | |
|---|---|---|---|---|
| FR | 2 264 265 | * | 10/1975 | 89/1.815 |
| FR | 2 518 737 | * | 6/1983 | 89/1.816 |
| SE | 133 673 | * | 11/1951 | 89/1.814 |

* cited by examiner

*Primary Examiner*—Stephen M. Johnson
(74) *Attorney, Agent, or Firm*—Hoffman, Wasson & Gitler, P.C.

(57) ABSTRACT

A rocket assisted payload launch system includes a heavy gauge metal shipping container that houses an array of containerized concentric launch tubes, or canisters. Spacers on each containerized concentric launch tube contact the adjacent tubes and retain the centers of the tubes a predetermined distance apart, and in a vertical orientation. A missile including rocket assisted payload (RAP) can be inserted into the open upper end of each tube, which also has a curved, closed bottom end. Umbilical cords are connected to each tube for providing target location information to the missile placed therein. A sequence controller selects the rocket assisted payload to be fired, and initiates the firing sequence by delivering power, via the umbilical cord, to the selected missile. The sequence controller may be manually operated, or may be operated, automatically, via a datalink, in the preferred mode of operation.

5 Claims, 4 Drawing Sheets

CONTAINERIZED ROCKET ASSISTED PAYLOAD (RAP) LAUNCH SYSTEM

FIELD OF THE INVENTION

The instant invention pertains to a containerized rocket assisted payload (RAP) launching system that includes a metal shipping container with an array of closely spaced, vertically oriented containerized concentric launching (CCL) tubes housed therewithin.

BACKGROUND OF THE INVENTION

Navy warships using guns to a maximum range of 15 miles have traditionally provided naval fire support for the Marine Corps and Army. The introduction of Tomahawk missiles increased the range of the fire support, but the size and expense of the missiles precludes meeting the volume of fire needed by the Marine Corps and Army. Navy warships are built to meet multipurpose warfighting requirements and therefore cannot carry sufficient gun ammunition or Tomahawk missiles to support a 30-day naval fire support mission for the Marine Corps or Army.

One approach to handling different missiles utilizes multipurpose launchers, of modular construction, which can be reconfigured, as necessary. The modular launchers can launch missiles, rockets, chaff and decoys. U.S. Pat. No. 5,452,640, granted Sep. 26, 1995, to Stan P. Bovee et al, discloses such a modular system—see FIGS. 7–9 and note column 2, line 36–column 3, line 29. FIGS. 10–11 show, in schematic fashion, the electronic circuitry for selectively firing the launchers.

U.S. Pat. No. 5,942,713, granted Aug. 24, 1999, to Leszek S. Basak, addresses the conflicting demands of increased firepower, and limited space, upon naval ships, in a different manner. Basak discloses a multiple missile launcher (12) having a plurality of canister holding chambers or cells (14*s*, 14*b*, 14*c*, 14*d*, 143, 14*f*, 14*g*, 14*h*). Each canister includes a standard connector (16*c*) for connection by a standard cable (17) to a mission launch sequencer (410; see FIG. 4). Each canister is loaded with four missiles (316; see FIG. 3). The cable has more than enough signal paths to couple launch and safe signals to a single missile, but not sufficient signal paths to independently control four missiles. Selection signals are sent over a selected one of the four separate signal paths to directly arcuate a relay (405, 406, 407 and 408) associated with the selected one of the missiles.

Although the Basak patent provides increased missile packed density, the need for even further space saving measures, upon naval ships, remains unsatisfied. Also, the need for safely transporting and handling large quantities, of densely packed rocket assisted payloads (RAP), of diverse configurations, remains unaddressed. Similarly, the need to determine the appropriate ship platform (naval warships or commercial container ships) to deploy and launch the rocket assisted payloads (RAP) must be resolved, or a common platform must be created. Applicant has addressed these problems and devised a solution that can be effectively implemented, by all branches of the military.

BRIEF SUMMARY OF THE INVENTION

The instant invention includes a metal shipping container, of sturdy design, that is transported by ship, truck and/or train, to a desired location for deployment. An array of vertically oriented, closely spaced, containerized concentric launch (CCL) tubes is retained within the container, and a launching mechanism is incorporated into the container in operative relationship to the array of CCL tubes. Rocket assisted payloads (RAP), each including a solid rocket booster, are loaded into the CCL tubes.

Signals, representing the location coordinates for a military target, are relayed to the launching mechanism, via a radio-link or global positioning system. The coordinates are downloaded into each rocket assisted payload (RAP) and an ignition signal is transmitted via an umbilical cord to the selected rocket assisted payload (RAP). The solid rocket booster propels the selected missile upwardly and into a ballistic path. The rocket booster falls away and the wings and fins on the rocket assisted payload (RAP) come into play. The rocket assisted payload (RAP) flies to the target, in a ballistic arc, guided by its own laser, video, or global positioning navigational system. The accuracy of each rocket assisted payload (RAP) is enhanced, and the volume of fire power generated by each container is increased several-fold over known fire support systems, while the extended range of over 200 miles exceeds all naval fire support systems currently in use or in the planning stage.

DETAILED DESCRIPTION OF THE PREFERRED EMBODIMENT

Figure 1:
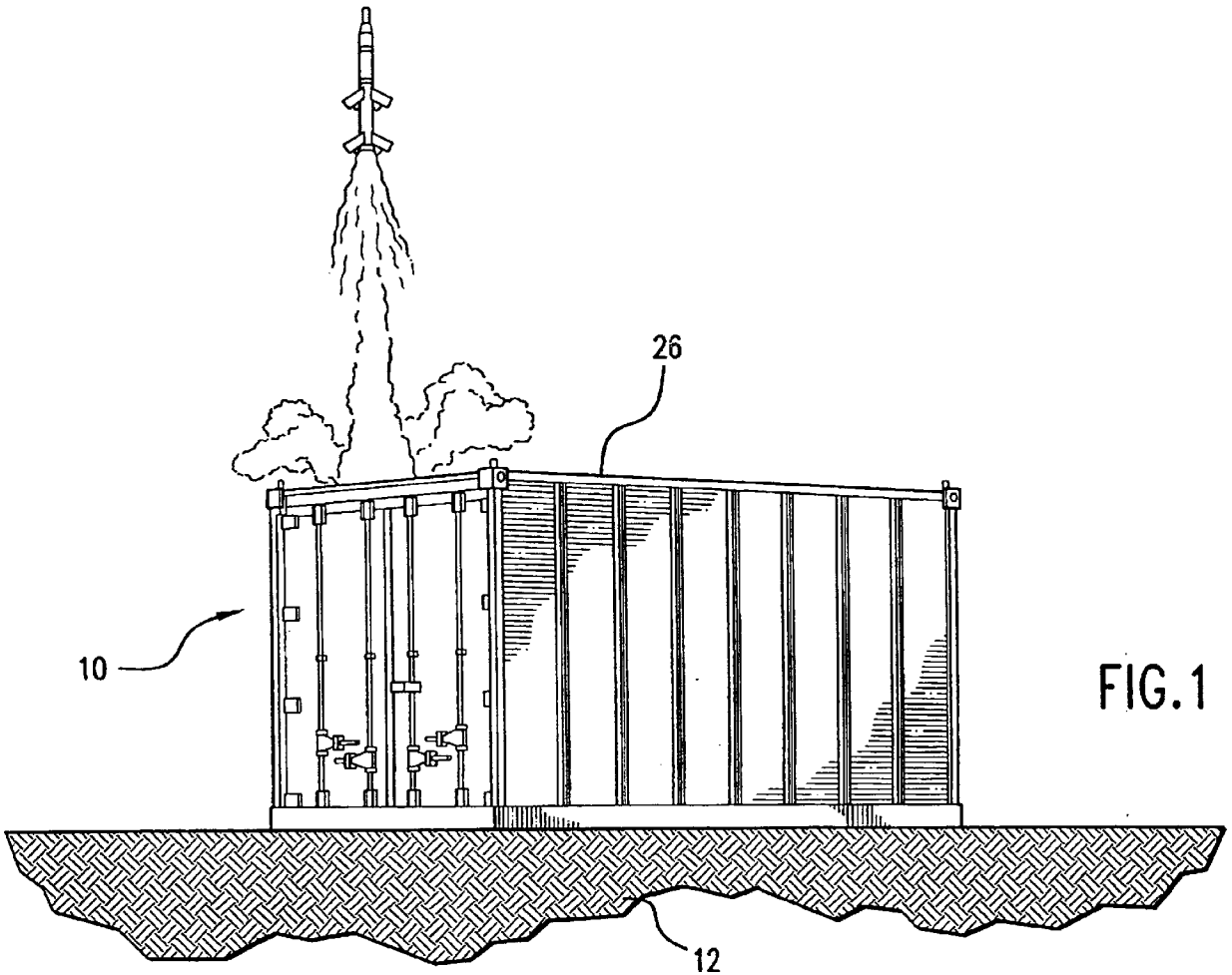
FIG. 1 is a perspective view of a rocket assisted payload (RAP) being launched from a shipping container resting on the deck of a ship; the shipping container being constructed in accordance with the principles of the instant invention.

FIG. 1 shows a metal shipping container 10, of known construction, resting upon a platform 12, such as the deck of a naval Roll On/Roll Off (RO/RO), vessel. Container 10 is rectangular in horizontal and vertical cross-sections.

Container 10 is built to international standards, such as ISO, and its dimensions will be twenty feet in length, eight feet in width, and eight feet in height. Double height containers may be made to accommodate larger payloads or greater ranges. The container, and its contents, can be transported on the deck of a cargo vessel, on the flat bed of a truck, and may be transportable by freight train, as on a flat car. The container may also be transportable in the hold of a large military transport plane.

The containers may also be stacked on top of one another, or side by side, if space permits. The rigidity of container 10, and its heavy gauge metal or steel fabrication, increases its value as a shipping container, and ultimately as a housing for rocket launchers.

Figure 2:
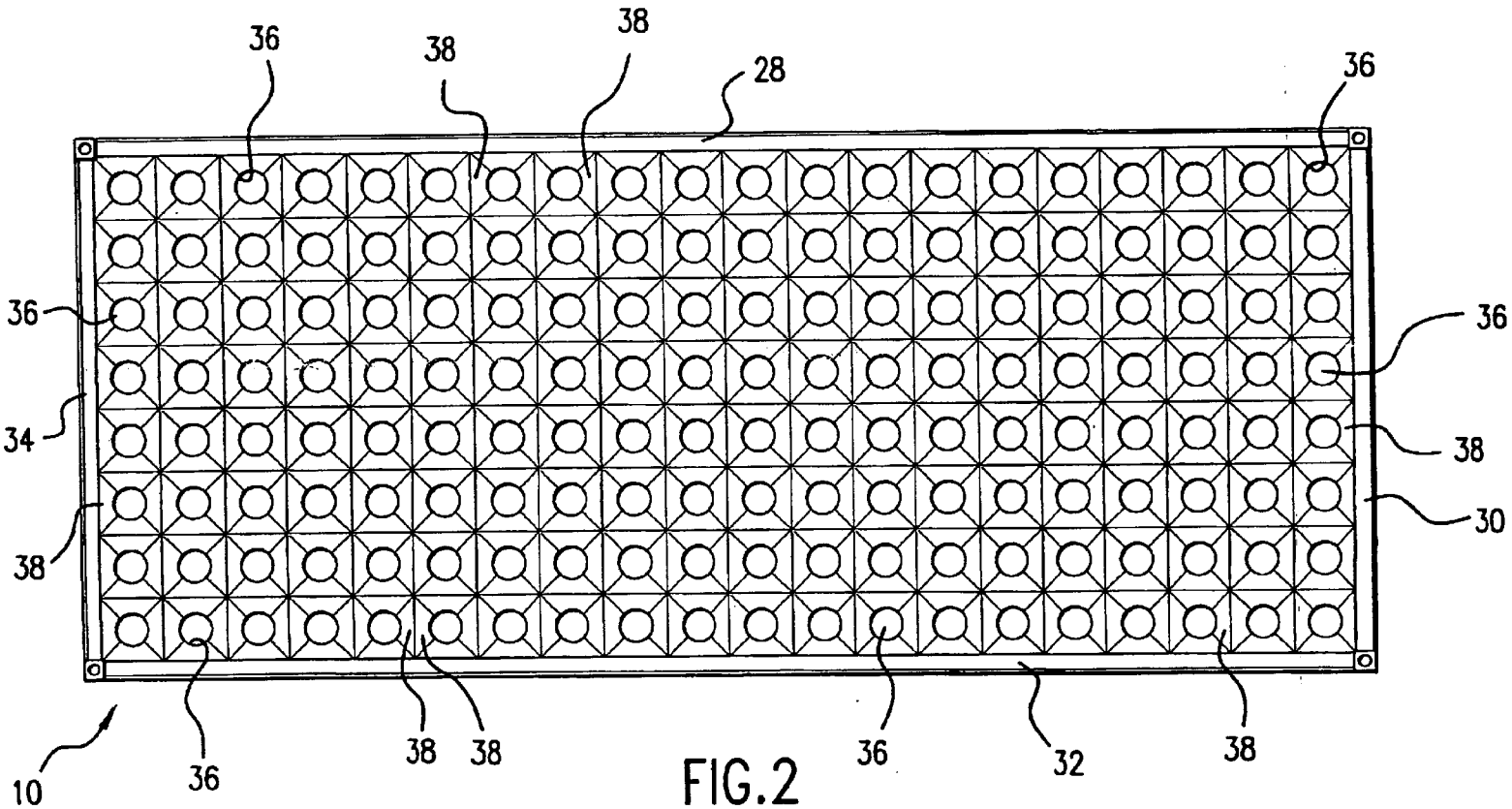
FIG. 2 is a top plan view of the shipping container of FIG. 1, showing an array of containerized concentric launch (CCL) tubes, for discharging rocket assisted payloads (RAP)

FIG. 2 shows the densely packed interior of container 10. Roof 26 has been removed for clarity in FIG. 2. Braces 28, 30, 32 and 34 strengthen container 10. Containerized concentric launch (CCL) tubes 36, for discharging rocket assisted payloads (RAP), are retained in a tightly packed array, by spacers 38, 40 holding each tube a fixed distance, such as a foot, away from the adjacent rocket assisted payload containerized concentric launch tube 36. One hundred and sixty missile tubes could be retained, in operative position, within container 10, with the tube centers one foot apart, as suggested in FIG. 2. The number of containerized concentric launch (CCL) tubes packed in a container will vary based on the size of the payload and the maximum required range.

Figure 3:
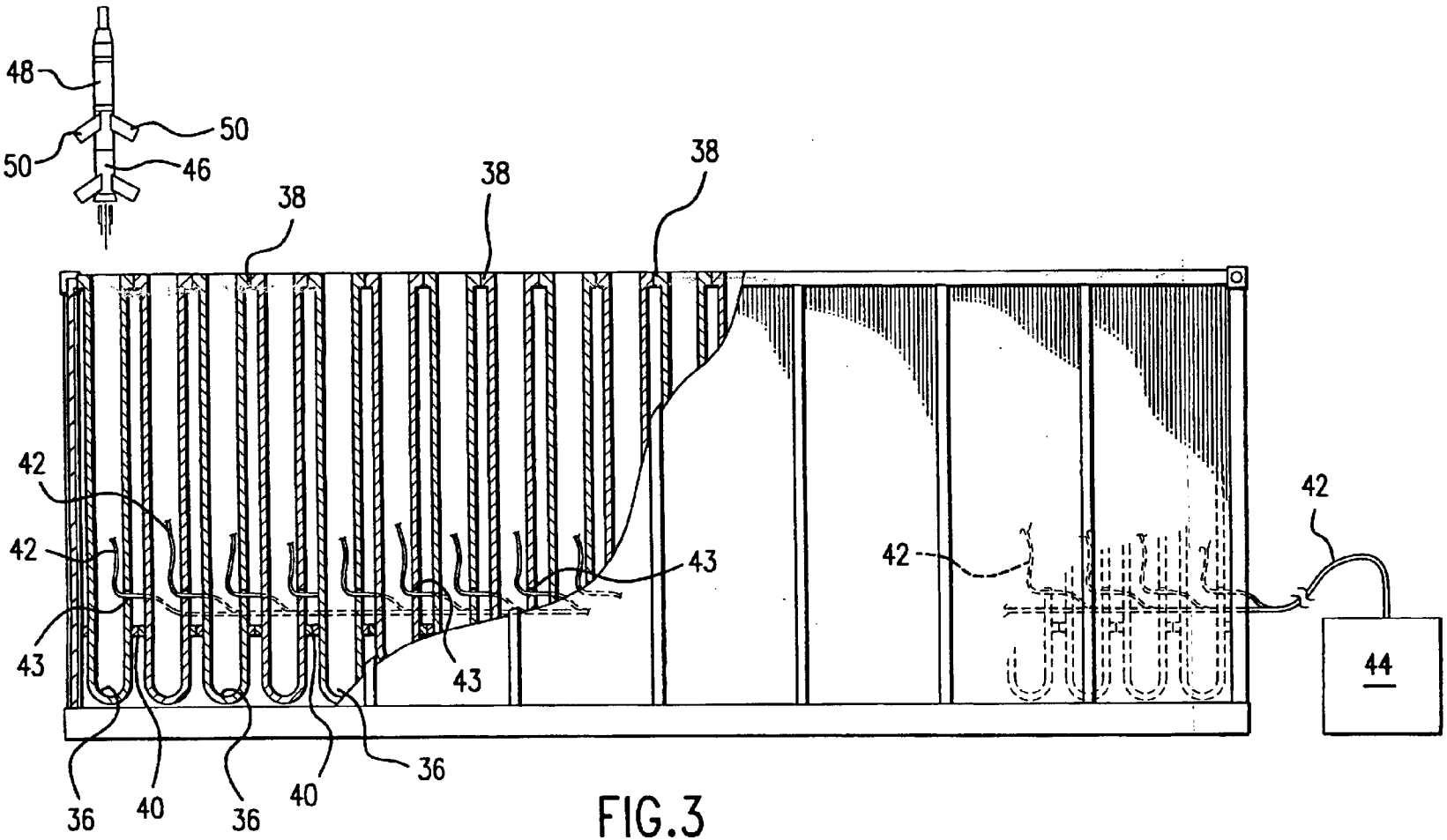
FIG. 3 is a side elevational view of the container of FIGS. 1 and 2, with portions of a side wall removed to show the vertical orientation of the containerized concentric launch (CCL) tubes.

FIG. 3 illustrates one row of containerized concentric launch (CCL) tubes 36 retained in a vertically upright orientation for discharging rocket assisted payloads (RAPs). An umbilical cord 42 extends from each tube to the exterior of container 10, and is connected, via cable, passed through an opening 43 in each launch tube 36 to launch sequence controller 44 for rocket assisted payloads (RAP). The controller determines which of the containerized concentric launch (CCL) tubes and rocket assisted payloads should be energized, so that the rocket assisted payload (RAP) 48 retained therein, will be fired. The rocket assisted payload is uploaded with target position and launch position and upon ignition is launched, in a vertical orientation, though selected launch tube 36. The booster rocket 46 for each rocket assisted payload 48 propels the missile in a ballistic path until the booster is spent and falls away from the payload 48. The wings 50, and fins, on the payload or main body 48, are then deployed, and guide the missile to the target, by virtue of an internal global positioning system, a video system, or a laser system, that provides the coordinates for the target.

Figure 4:
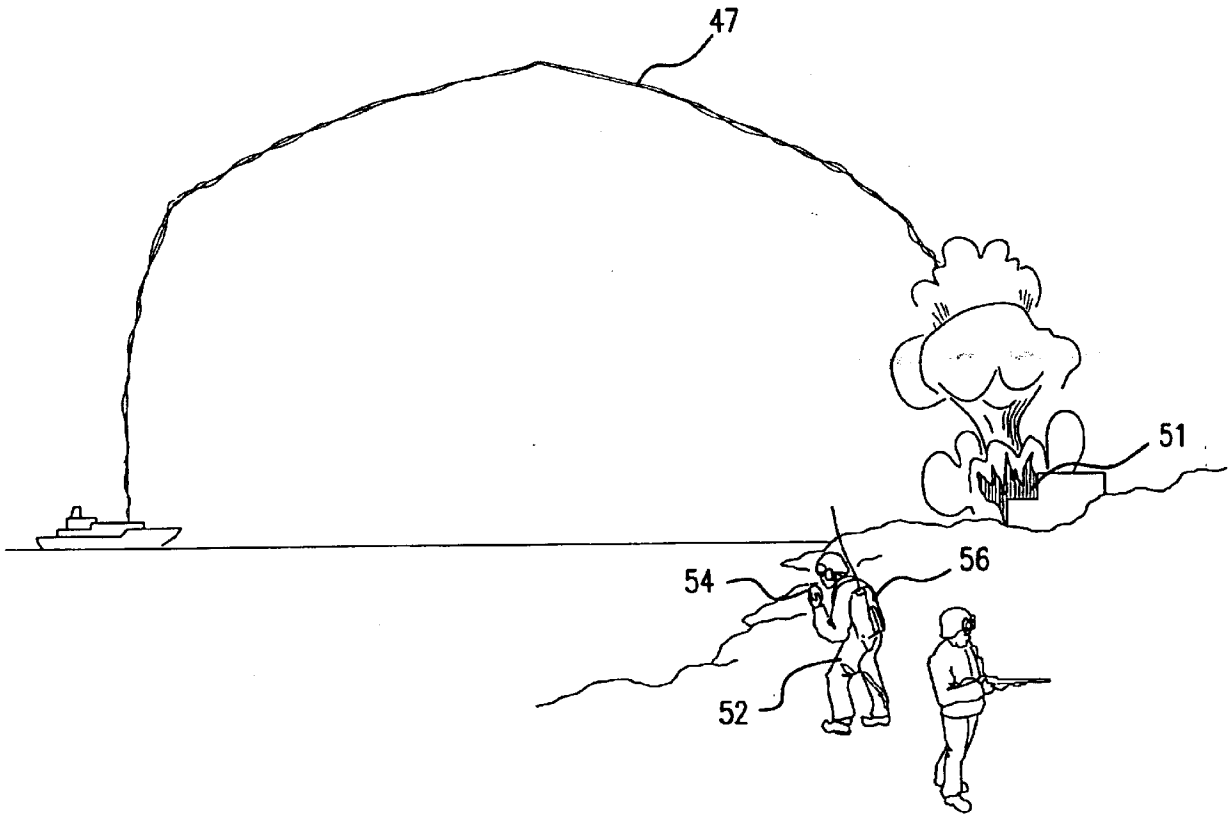
FIG. 4 is a schematic view of a ship, utilizing applicant's shipping container, directing a rocket assisted payload (RAP) toward an on-shore target.

FIG. 4 traces the path of rocket assisted payload 48, from container 10 on the deck of the ship to its target on land over one hundred miles away. Rocket assisted payload 48, after leaving containerized concentric launch (CCL) tube 36, rises vertically to clear the ship. Booster 46 then falls away, the wings 50 and fins are then deployed, and the payload 48 follows a ballistic arc 47 until crashing into target 51. The coordinates for target 31 may be relayed by on-shore observers 52 via hand held radio transmitters 54 supported by power pack 56, as shown in FIG. 4. Alternatively, the coordinates for target 57 may be determined by aerial reconnaissance systems, "spy" satellites, naval fire support data links, etc.

The fire support system described above is intended for use with diverse rocket assisted payloads, such as a 155 mm. payload, suitable for use as an armor piercing, anti-personnel (fragmentation), and white phosphorus payload. Such rocket assisted payloads have been developed for different purposes, by different branches of the military, and are known as the Copperhead, the Excalibur, and the Rum-139 (vertical launch (ASROC).

Various other modifications and revisions to the missile launch system will occur to the skilled artisan after reviewing the specification and drawings. Consequently, the appended claims should be liberally construed in a manner consistent with the spirit and scope of the invention, and should not be limited to their literal terms.

I claim:

1. A rocket assisted payload launch system comprising:

a) a metal container including first and second end walls, said end walls being parallel to each other;

b) said container further including first and second side walls, said side walls being parallel to each other;

c) a bottom wall extending between said end walls and said side walls to seal said container;

d) a plurality of containerized concentric tubes retained within the interior of said container for discharging rocket assisted payloads;

e) each rocket assisted payload including a booster rocket, and a payload releasably mounted atop said booster rocker;

f) each containerized concentric launch tube having a sealed bottom and an upwardly opening top;

g) means for retaining said containerized concentric launch tubes in a fixed upstanding, vertically oriented array within the interior of said container;

h) an umbilical cord connected to the each containerized concentric launch tube and adapted to deliver power for ignition to the booster rocket of the a rocket assisted payload inserted into the tube; and i) a sequence controller connected to the umbilical cord of each rocket assisted payload within a containerized concentric launch tube so that the booster rockets for the rocket assisted payloads within the containerized concentric tubes can be selectively energized by said controller.

2. A rocket assisted payload launch system as defined in claim 1 wherein said container is twenty feet in length, eight feet in width, and eight feet high.

3. A rocket assisted payload launch system as defined in claim 2 wherein containers are stacked atop one another to increase the capacity of the system.

4. A rocket assisted payload launch system as defined in claim 2 wherein containers are stacked adjacent to each other to increase the capacity of the system.

5. A rocket assisted payload launch system as defined in claim 1 wherein said containerized concentric launch tubes are maintained about a foot apart, measured from the center of one missile launch to the center of the adjacent missile launch tube.

* * * * *